United States Patent [19]

Kitchen et al.

[11] 4,181,066

[45] Jan. 1, 1980

[54] EXPANSIBLE CHAMBER MOTOR

[75] Inventors: Clarence E. Kitchen, Bridgeton; Jerome B. Wegmann, St. Louis County, both of Mo.

[73] Assignee: McNeil Corporation, Akron, Ohio

[21] Appl. No.: 876,574

[22] Filed: Feb. 10, 1978

[51] Int. Cl.[2] ..... F01L 25/06; F01L 31/02

[52] U.S. Cl. ..... 91/306; 91/307; 91/337; 91/346; 91/405; 91/444

[58] Field of Search ..... 91/307, 396, 306, 305

[56] References Cited

U.S. PATENT DOCUMENTS

| | | | |
|---|---|---|---|
| 2,407 | 12/1866 | Cameron | 91/307 |
| 1,406,330 | 2/1922 | Barnes | 91/307 |
| 2,215,852 | 9/1940 | Klein | 137/625.25 |
| 2,269,423 | 1/1942 | Barks et al. | 251/103 |
| 2,404,315 | 7/1946 | Rotter et al. | 74/100 R |
| 2,437,391 | 3/1948 | Klein et al. | 91/286 |
| 2,750,932 | 6/1956 | Klein | 91/287 |
| 2,944,528 | 7/1960 | Phinney | 91/55 |
| 3,232,379 | 2/1966 | Mueller et al. | 184/6.8 |
| 3,805,672 | 4/1974 | Pekrul | 91/396 |

FOREIGN PATENT DOCUMENTS

| | | | |
|---|---|---|---|
| 867399 | 7/1949 | Fed. Rep. of Germany | 91/307 |

*Primary Examiner*—Paul E. Maslousky

*Attorney, Agent, or Firm*—Koenig, Senniger, Powers and Leavitt

[57] ABSTRACT

An air motor comprising a cylinder, a piston, and a valve mechanism for controlling the supply and exhaust of air to and from opposite ends of the cylinder, the valve mechanism comprising a D-valve and an actuator for the D-valve operable by the pressure air for driving the piston, movement of the actuator being controlled by valves at opposite ends of the cylinder for exhausting air from opposite ends of the actuator, these exhaust valves being operated by the piston, and the motor having means operable by the piston at each end of its stroke for restricting the exit of air from the cylinder to cushion the piston and prevent it from striking the ends of the cylinder.

12 Claims, 11 Drawing Figures

EXPANSIBLE CHAMBER MOTOR

BACKGROUND OF THE INVENTION

This invention relates to expansible chamber motors, and more particularly to a cylinder and piston type air motor of this class, such as is used, for example, for driving a lubricant pump or the like.

This invention involves an air motor of the same general type as the air motors shown in U.S. Pat. Nos. 2,215,852, 2,269,423, 2,404,315, 2,437,391, 2,750,932, 2,944,528 and 3,232,379. It is especially concerned with an air motor having a quick-acting valve mechanism for actuating the distributing valve (the "D-valve") of the motor without the use of an overcentering mechanism (as in the first two U.S. patents mentioned) or a rocker arm type of mechanism (as in the next four U.S. patents mentioned) for actuating the valve mechanism. It involves an improvement on an earlier air motor having an actuator for the D-valve operable by the pressure air supplied for driving the piston of the motor, wherein the movement of the actuator was controlled by valves at opposite ends of the cylinder for supplying pressure air to opposite ends of the actuator, these valves being operable by the piston, but which had various disadvantages, including the disadvantage of being excessively noisy due to impact of the piston at the ends of its stroke on the cylinder end heads, and of having relatively complex passaging. Another problem in prior air motors of this type has been that of maintaining the same length of stroke of the piston for different speeds of the piston.

SUMMARY OF THE INVENTION

Among the several objects of this invention may be noted the provision of an improved cylinder and piston air motor having an improved valve mechanism comprising a D-valve and an actuator for the D-valve operable by the pressure air supplied for driving the piston, without the use of any overcentering or rocker arm mechanisms, which is relatively quiet in operation, without clatter of the piston against the cylinder end heads; the provision of such a motor with simplified passaging for the air system for the D-valve actuator; and the provision of such a motor in which the length of stroke of the piston is maintained generally the same for different piston speeds.

In general, an expansible chamber motor of this invention comprises a cylinder having first and second end heads, a motor piston reciprocable in the cylinder between said end heads, and valve mechanism for the motor comprising air passage means having a valve face at one side of the cylinder, a central exhaust port and first and second feed ports on opposite sides of the exhaust port, with said ports in line endwise of the motor, a first feed passage in communication at one end with the first feed port and at its other end with a first end of the cylinder, and a second feed passage in communication at one end with the second feed port and at its other end with the second end of the cylinder. The valve mechanism further comprises a valve chest extending along the stated valve face having first and second aligned piston-receiving bores at its opposite ends with a chamber between said bores for air under pressure. A valve actuator is movable axially in the chest, this actuator having a central portion and first and second pistons at the ends of the central portion slidable in the first and second piston-receiving bores, the pistons at their inner ends being exposed to pressure air in the chamber, the latter being in restricted communication with the outer ends of the bores. A D-valve is movable with the actuator and slidable on the valve face, being movable with the actuator between a first position wherein it provides for communication of pressure air from the chamber through the first feed port via the first feed passage to the first end of the cylinder, and for exhaust of air from the second end of the cylinder via the second feed passage, the second feed port and the D-valve to the exhaust port, for driving the motor piston in the direction from the first to the second end head, and a second position wherein it provides for communication of pressure air from the chamber through said second feed port via the second feed passage to the second end of the cylinder and for exhaust of air from the first end of the cylinder via the first feed passage, the first feed port and the D-valve to the exhaust port, for driving the motor piston in the opposite direction. A first exhaust passage provides for exhausting air from the outer end of the first piston-receiving bore, and a second exhaust passage provides for exhausting air from the outer end of the second piston-receiving bore. A first exhaust valve for the first exhaust passage is operable by the piston as the piston approaches the second end of the cylinder for exhausting air from the outer end of the first piston-receiving bore, thereby to move the actuator to move the D-valve from the first to the second position, and a second exhaust valve for the second exhaust passage is operable by the piston as the piston approaches the first end of the cylinder for exhausting air from the outer end of the second piston-receiving bore, thereby to move the actuator to move the D-valve from the second to the first position.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 2:
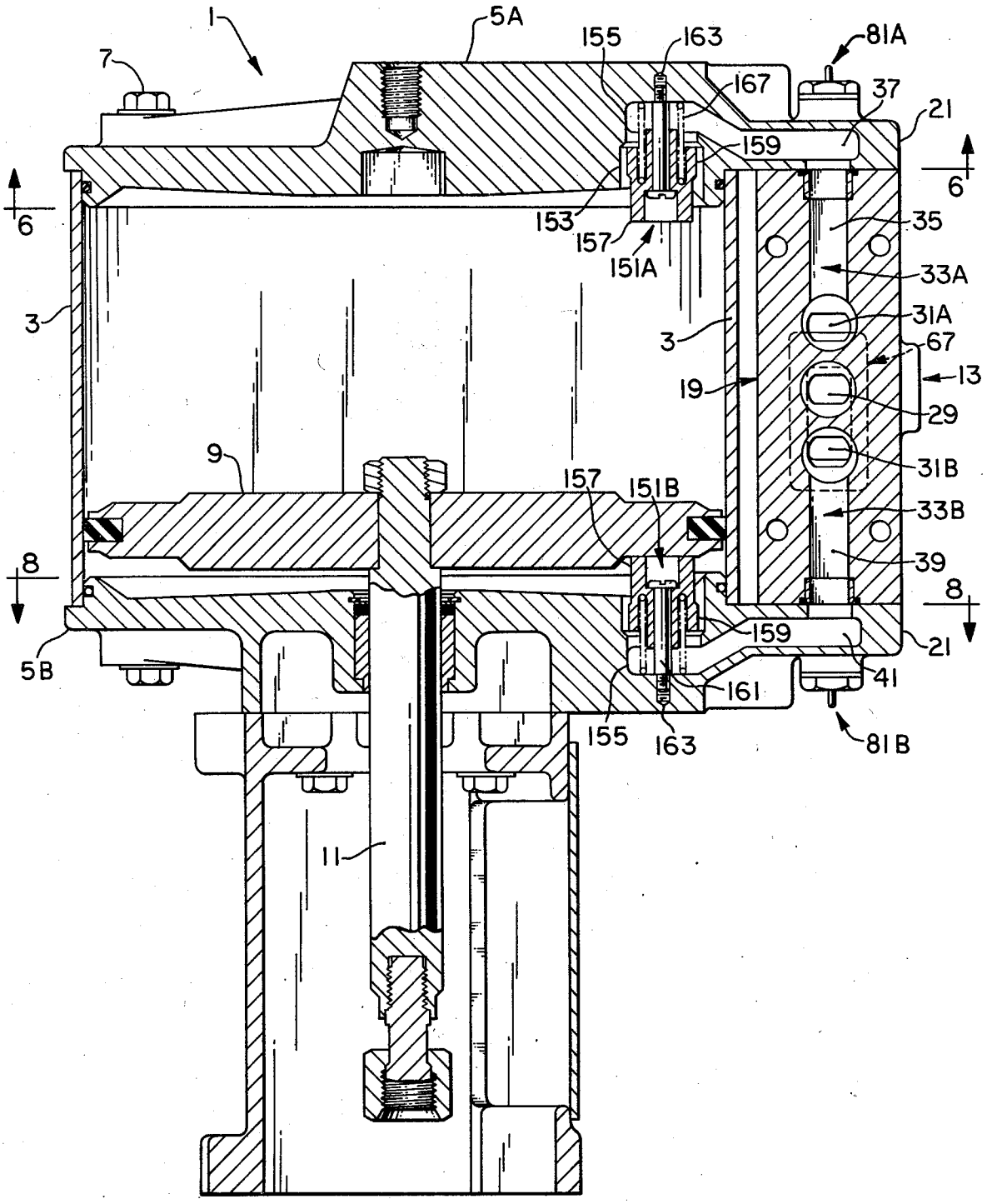
FIG. 2 is a vertical longitudinal section of the motor on line 2—2 of FIG. 1, showing the motor piston in the motor cylinder approaching the lower end of its stroke, about to reverse and move up.
Figure 3:
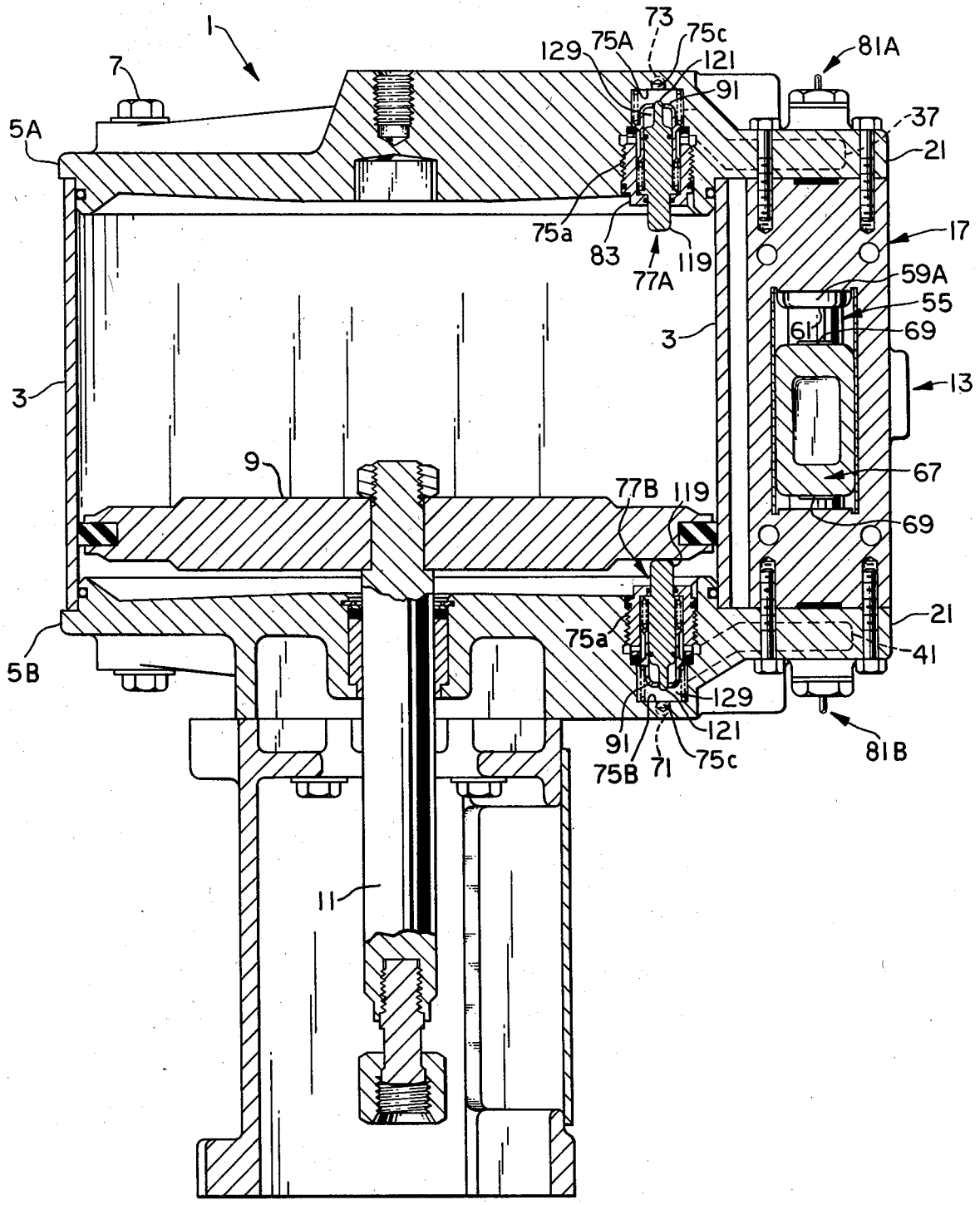
FIG. 3 is a vertical longitudinal section of the motor on line 3—3 of FIG. 1, showing the piston approaching the lower end of its stroke, about to reverse and move up.
Figure 4:
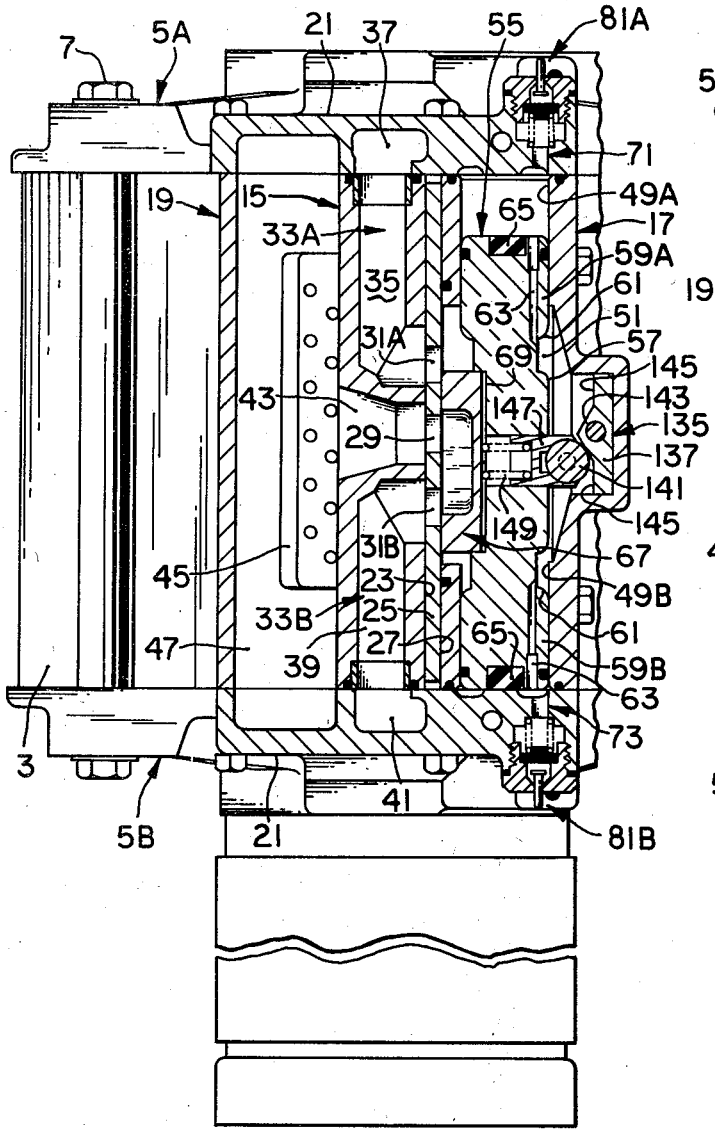
FIG. 4 is a vertical section generally on line 4—4 of FIG. 1, showing the D-valve actuator and D-valve of the valve mechanism of the motor in position at the lower end of their stroke, wherein the D-valve is set for driving the piston down as in FIG. 2.

Referring to the drawings, there is generally indicated at 1 an expansible chamber motor and specifically an air motor of this invention, comprising a cylinder 3 (which in use generally occupies a vertical position as shown in FIGS. 2 and 3) having first and second end heads 5A and 5B (the first being the upper and the second being the lower end head as viewed in FIGS. 3 and 4). These heads are secured on the upper and lower ends of the cylinder by bolts 7 in conventional manner. A motor piston 9 is reciprocable up and down in the cylinder between the end heads, being fastened on the end of a piston rod 11 which extends down through the lower end head 5B. At 13 on one side of the cylinder (its right side as illustrated in FIGS. 2 and 3) is generally indicated valve mechanism for the motor, this valve mechanism including what may be referred to as air passage means generally designated 15 and a valve chest generally designated 17. The air passage means 15 comprises a block 19 of generally rectangular shape in cross section extending vertically between laterally projecting portions 21 of the end heads, this block having a vertical face designated 23 (see FIG. 4) and a valve plate 25 on face 23 sandwiched between the block and the valve chest 17. The latter seals against the face 27 of the plate, this face being referred to as the valve face. The valve plate 25 has a central exhaust port 29, a first feed port 31A and a second feed port 31B (see FIG. 4). The feed ports are on opposite sides of the exhaust port, and the feed ports and exhaust port are in line endwise (vertically) of the motor, with 31A toward its first end (its upper end) and 31B toward its second end (its lower end). At 33A is indicated a first feed passage which is in communication at one end with the first feed port 31A and at its other end with the first (upper) end of the cylinder 3 via a passage 35 in the block 19 and a passage 37 in the upper end head 5A. At 33B is indicated a second feed passage in communication at one end with the second feed port 31B and at its other end with the second (lower) end of the cylinder via a passage 39 in the block 19 and a passage 41 in the end head 5B. The exhaust port 29 communicates via an exhaust passage 43 in the block 19 with an exhaust chamber 47 in the block, which in turn communicates with the surrounding atmosphere via a noise suppressor 45.

Figure 1:
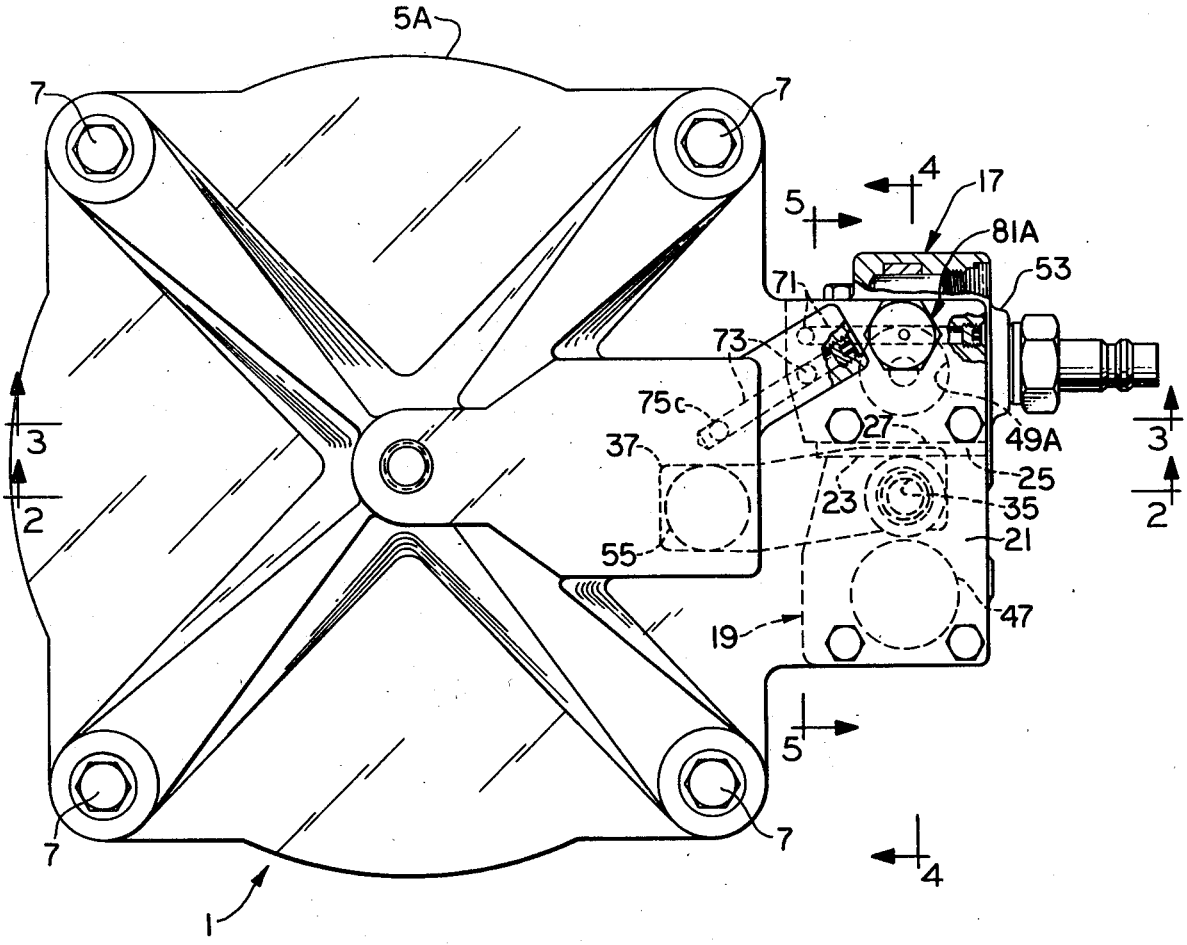
FIG. 1 is a plan of an air motor of this invention.

The valve chest 17 comprises a block of generally rectangular cross section extending between the laterally extending portions 21 of the end heads, and having first and second (upper and lower) aligned piston-receiving cylinders or bores 49A and 49B (see FIG. 4) at its opposite (upper and lower) ends with a chamber 51 between these bores for air under pressure. At 53 in FIG. 1 is indicated an inlet for air under pressure from a suitable source (e.g., an air compressor) to the chamber 51. A valve actuator 55 is movable axially in the valve chest, having a central portion 57 and first and second (upper and lower) pistons 59A and 59B at the ends of the central portion 57 slidable in the bores 49A and 49B. Each of these pistons has an inner face 61 exposed to pressure air in the chamber 51, which is in restricted communication with the outer ends of the bores 49A and 49B via a bleed passage 63 in each piston. The actuator 55 is movable between a first (lower) position (FIG. 4) wherein its lower end engages the projecting part 21 of the second or lower end head and a second (upper) position wherein its upper end engages the projecting part 21 of the first or upper end head 5A, and has bumpers 65 at its upper and lower ends for cushioning the impact of the actuator on the end heads.

A distributing valve or, as it is known in the art, a D-valve, for controlling the supply of air to and the exhaust of air from opposite ends of the cylinder is indicated at 67 and is movable with the actuator 55, being received in a notch 69 in the central portion 57 of the actuator and slidable on the face 27 of the valve plate 25 in line with the ports 31A, 29 and 31B. The D-valve is movable with the actuator between a first position (corresponding to the stated first or lower position of the actuator shown in FIG. 4) wherein it provides for communication of pressure air from chamber 51 through the first (upper) feed port 31A via the first feed passage 33A to the first (upper) end of the cylinder 3 and for exhaust of air from the second (lower) end of the cylinder via the second feed passage 33B, the second feed port 31B and the D-valve 67 to the exhaust port 29 for driving piston 9 in the direction (down) from the first end head 5A to the second end head 5B, and a second position (corresponding to the stated second or upper position of the actuator) wherein it provides for communication of pressure air from chamber 51 through the second (lower) feed port 31B via the second feed passage 33B to the second (lower) end of the cylinder and for exhaust of air from the first (upper) end of the cylinder via the first feed passage 33A, the first feed port 31A and the D-valve 67 to the exhaust port 29 for driving the piston 9 up in the opposite direction.

Figure 5:
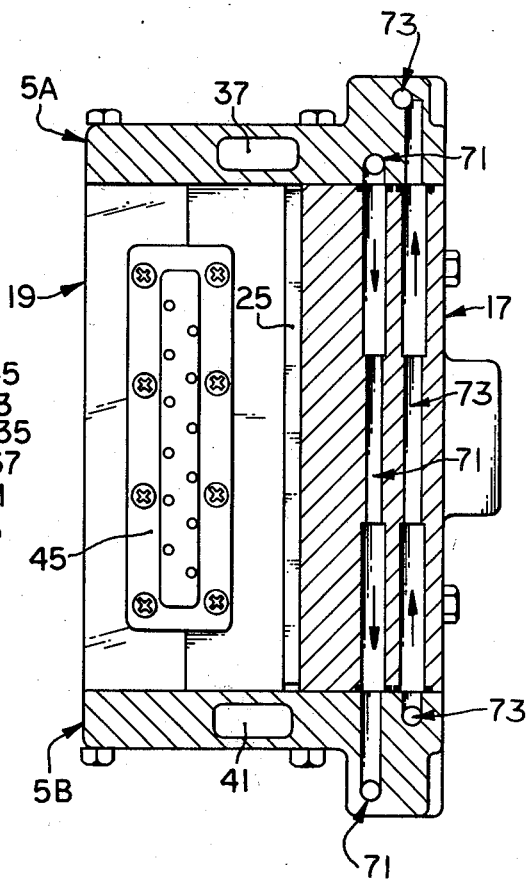
FIG. 5 is a vertical section generally on line 5—5 of FIG. 1.
Figure 6:
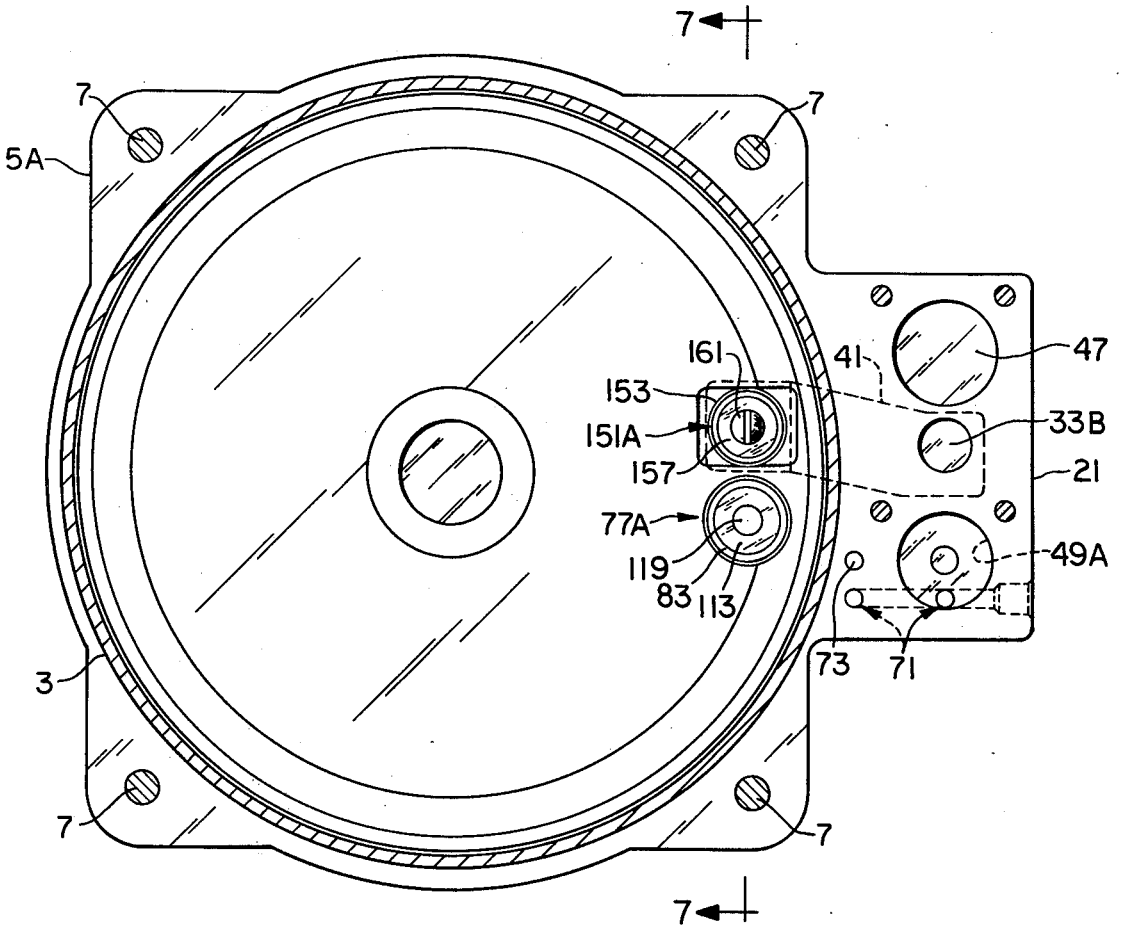
FIG. 6 is a horizontal section generally on line 6—6 of FIG. 2.
Figure 7:
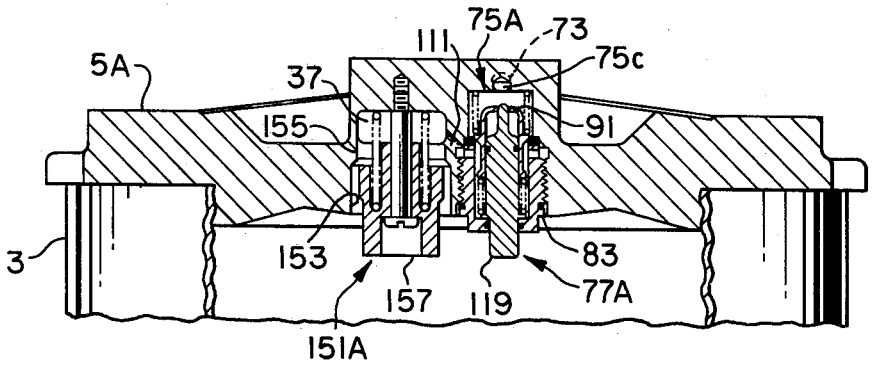
FIG. 7 is a vertical section on line 7—7 of FIG. 6.
Figure 8:
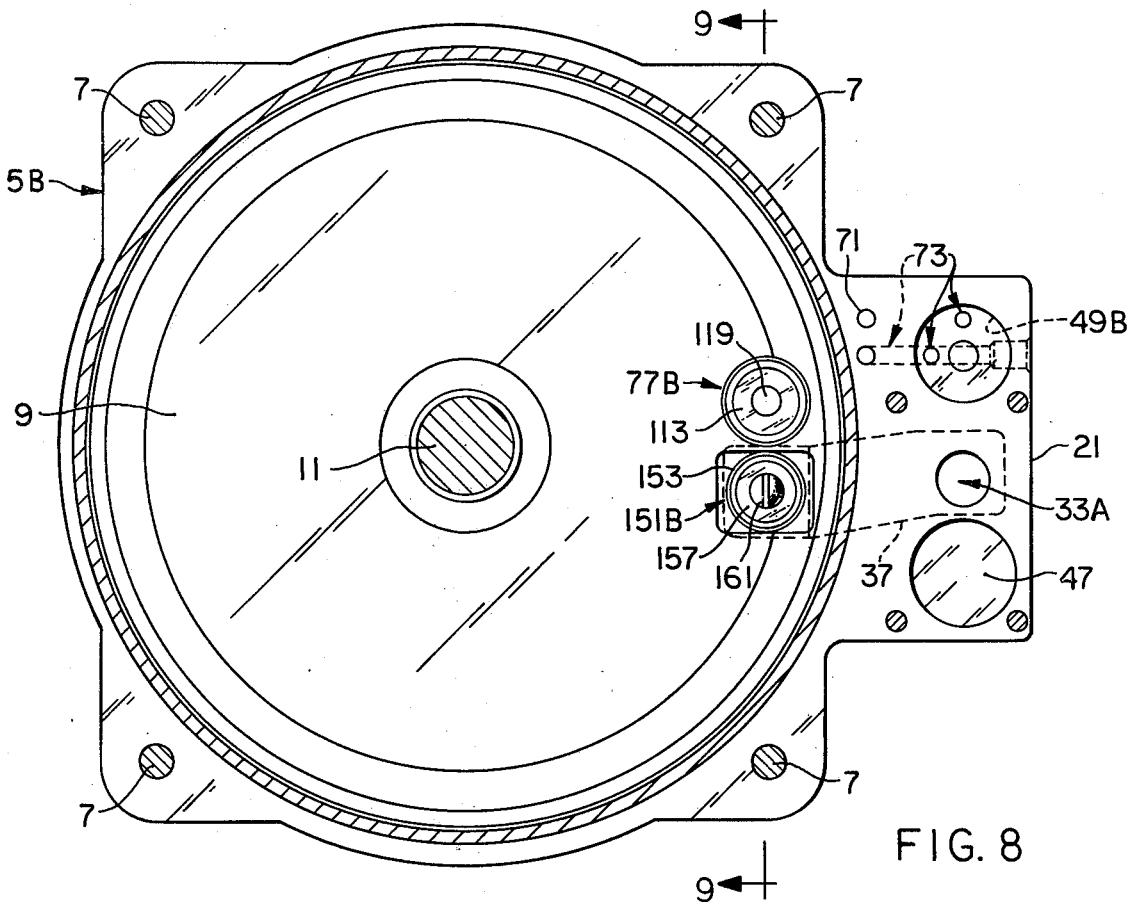
FIG. 8 is a horizontal section on line 8—8 of FIG. 2.
Figure 9:
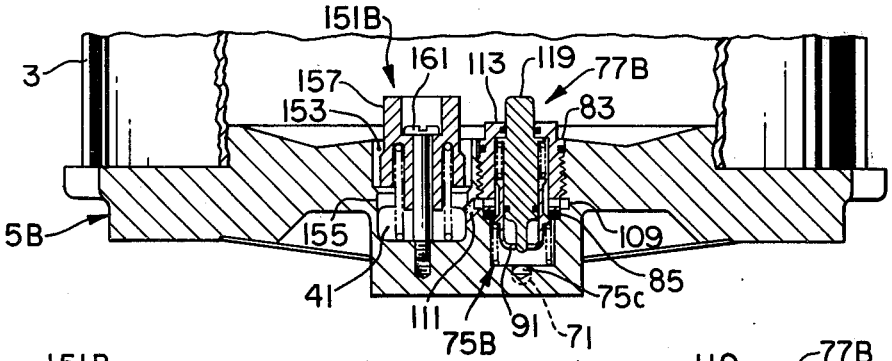
FIG. 9 is a vertical section on line 9—9 of FIG. 8.

At 71 is indicated a first exhaust passage, for exhausting air from the outer (upper) end of the first (upper) bore 49A and at 73 is indicated a second exhaust passage for exhausting air from the outer (lower) end of the second (lower) bore 49B. The passage 71 extends through portion 21 of the head 5A as shown in FIGS. 1, 4 and 5, thence longitudinally of the valve chest 17 as shown in FIG. 5 to portion 21 of the head 5B, and thence through the head 5B to a cylindrical recess 75B in the head 5B, this recess extending out (down) from the inside (upper) face of the head 5B and containing a first exhaust valve generally designated 77B operable by the piston 9 as the piston approaches the head 5B (at the lower end of the cylinder 3) for opening the passage 71 for exhausting air from the outer end of the first bore 49A, thereby to move the actuator 55 to move the D-valve 67 from its lower (first) position in which it is shown in FIG. 4 to its upper (second) position, as will appear. The passage 73 extends through portion 21 of the head 5B, thence longitudinally through the valve chest 17 alongside the reach of passage 71 in the valve chest as shown in FIG. 5 to portion 21 of the head 5A, and thence through the head 5A to a cylindrical recess 75A in the head 5A, this recess extending out (up) from the inside (lower) face of the head 5A and containing a second exhaust valve 77A operable by the piston 9 as the piston approaches the head 5A (at the upper end of the cylinder 3) for opening the passage 73 for exhausting air from the outer end of the second bore 49B, thereby to move the actuator 55 to move the D-valve 67 from its upper (second) position to its lower (first) position, as will appear. A first manually operable exhaust valve 81A is provided in the head 5A for the first exhaust passage 71, and a second manually operable exhaust valve 81B is provided in the head 5B for the second exhaust passage.

Each of the recesses 75A and 75B (the one in the upper end head 5A, the other in the lower end head 5B)

has a tapped section 75a extending out from the inside face of the respective end head, a reduced-diameter section 75b at the end of 75a opposite the inside face of the head providing a shoulder 75s, and a still smaller diameter extension 75c of section 75b. Each of the motor-piston-operated exhaust valves 77A and 77B comprises a tubular body 83 threaded in its respective recess 75A, 75B from the inside face of the respective head 5A, 5B holding in place an annular valve seat 85 against the shoulder 75s. At 91 is indicated a valve member axially movable in the body 83, this member being a thin-walled tubular cylindric member having an integral head 93 at its outer end, an integral annular flange 95 projecting radially outwardly at its inner end, and an integral annular flange 97 projecting radially outwardly intermediate its ends having a conical inside face engageable with the valve seat 85 to close the valve. The valve member is biased inwardly for closure, i.e., for engagement of the inside conical face of flange 97 with the valve seat 85, by a spring 99 reacting from the outer end of the reduced-diameter outer end portion 75b of the recess against the outside face of the flange 97.

The passage 71 connects to the extension 75c of the recess 75B in head 5B and the passage 73 connects to the extension 75c of the recess 75A in head 5A. The valve body 83 has a reduced-diameter end extension 103 having radial ports 105 therein for communication from the space 107 within the body 83 around the valve member 91 to an annular space 109 around the extension 103 which is in communication via a passage indicated at 111 with the respective feed passage 37, 41. Thus, on opening the valve member 91 of valve 77A, passage 37 is vented and on opening the valve member 91 of valve 77B, passage 41 is vented.

The body 83 has an integral head 113 at its inner end. A valve stem 115 has a main cylindrical section 117, with a reduced-diameter push button portion 119 at the inner end of the main section axially slidable in a hole in the head 113 and extending into the cylinder 3 from the inside of the respective cylinder head, and a tip 121 at the outer end of the main section. It also has a radially outwardly extending integral flange 123 at the inner end of the main section 117. Section 117 of the valve stem extends into the tubular valve member 91 from the open end of the latter, having a sliding fit in the valve member 91 with a seal between section 117 and the inside of the valve member 91. The tip 121 of the valve stem extends through a hole 131 in the head 93 of the valve member, the arrangement being such that there is an annular dashpot chamber 129 in the valve member 91 around the tip 121 of the valve stem. This chamber is in restricted communication with the section 75b of the respective recess 75A, 75B via the hole 131 in the head 93 of the valve member. A spring 133 reacts from the flange 123 at the inner end of section 117 of the valve stem against the flange 95 at the inner end of the valve member 91, biasing the valve member 91 to slide outwardly on section 117 of the valve stem, in opposition to the spring 133 tending to push the valve member 91 inwardly. Spring 99 is stronger than spring 133.

At 135 in FIG. 4 is generally indicated means provided in accordance with this invention for effecting a snap action of the valve actuator 55 and preventing it from dead centering, by holding the actuator 55 from moving down until the pressure on the lower end of piston 59B has been substantially reduced, and from moving up until the pressure on the upper end of piston 59A has been substantially reduced. This snap-action means 135 for the actuator 55 comprises a detent 137 secured in a recess on the outside of the valve chest 17 and a roller 141 carried by the actuator 55. The detent 137 has a somewhat shallow V-shaped central projection 143 with flats 145 on opposite sides of the projection. The roller 141 is carried by a plunger 147 slidable in a lateral hole in the central body section 57 of the actuator 55 at the center of its length, the plunger being biased outwardly by a coil compression spring 149 reacting from the back of the D-valve 67 against the inner end of the plunger. When the actuator 55 is in its lower position (FIG. 4) roller 141 engages the lower flat 145 of the detent 137 and the actuator is thereby restrained from moving up until the pressure in the upper end of the upper bore 49A in the valve chest is reduced to the point where the pressure differential as between the lower and upper ends of the upper pistons 59A is sufficient to overcome the force of spring 149, whereupon the roller 141 is enabled to move up past the apex of the V-shaped projection 143 and the actuator snaps up to its upper (second) position. Similarly, when the actuator 55 is in its upper position, roller 141 engages the upper flat 145 of the detent and the actuator is thereby restrained from moving down until the pressure in the lower end of the lower bore 49B in the valve chest is reduced to the point where the pressure differential between the upper and lower ends of piston 59B is sufficient to overcome the force of the spring 149, whereupon the roller is enabled to move down past the apex of the V-shaped projection 143 and the actuator 55 snaps down to its lowered (first) position of FIG. 4.

Figure 10:
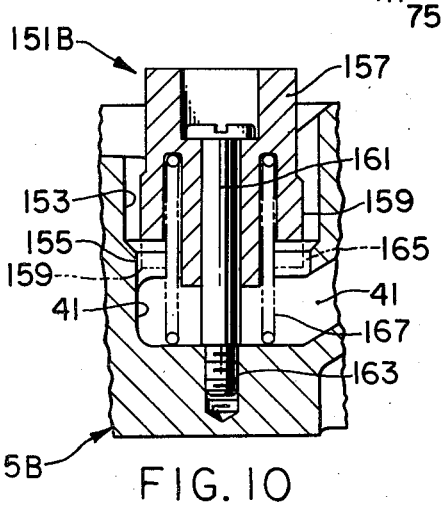
FIGS. 10 and 11 are enlarged fragments of FIG. 9.
Figure 11:
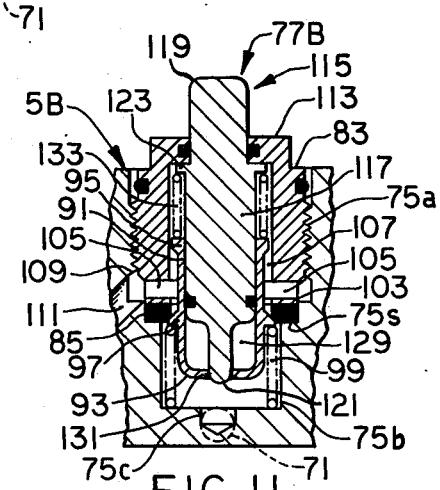

A first throttle valve means, designated 151A, is provided, operable by the motor piston 9 as it approaches the upper (first) end of the cylinder 3 for restricting (throttling) the exit of air from this end of the cylinder via the feed passage 37 to cushion the piston and prevent it from striking the upper (first) end head 5A of the cylinder. And a second throttle valve means, designated 151B, is provided, operable by the motor piston 9 as it approaches the lower (second) end of the cylinder for restricting (throttling) the exit of air from this end of the cylinder via the feed passage 41 to cushion the piston and prevent it from striking the lower (second) end head 5B of the cylinder. Each feed passage 37, 41 at its end in the respective end head 5A, 5B of the motor is in communication with the cylinder 3 via a cylindrical recess 153 extending out from the inside face of the end head and having a reduced-diameter cylindrical end section 155 in communication with the respective feed passage 37, 41 at its end in the end head. Each valve means 151A and 151B comprises a cylindrical valve member 157 having an end section 159 of a diameter somewhat smaller than the diameter of section 155 of the recess 153, this valve member being axially slidable on a guide 161 constituted by a screw member threaded at its end in a tapped hole 163 in the respective end head coaxial with the recess 153. The valve member 157 is slidable on the screw 161 from an extended full open position wherein its end section 159 is wholly withdrawn from section 155 of the recess 153 and wherein member 157 is extended from the recess into the cylinder, determined by engagement of its inner end with the head of the screw (as shown in solid lines in FIGS. 2, 7, 9 and 10) and a dashpotting position wherein its end section 159 is entered in section 155 of the recess (as shown in phantom in FIG. 10) to provide a restricted annular passage as indicated at 165 in FIG. 10 for throttling the flow of air from the cylinder to passage 37, 41

(as the case may be). The valve member 157 is biased by a spring 167 to its extended full open position, and is movable to its stated dashpotting position by engagement of the motor piston 9 with the inner end of the valve member. FIG. 2 shows the piston 9 as it approaches the lower end of its stroke and at the point where it has contacted the end of the valve member 157 of the lower valve means 151B and is about to drive this member 157 down to its dashpotting position.

Operation is as follows:

Assuming that the actuator 55 and the D-valve 67 are in their lower position of FIGS. 3 and 4, air under pressure is delivered from the chamber 51 of the valve chest 17 to the upper end of the cylinder 3 (above the motor piston 9) via port 31A, passages 35 and 37 (constituting feed passage 33A), section 155 of recess 153 in the upper end head 5A and the annular space around the valve member 157 of the upper throttle means 151A in this recess 153. The upper valve member 157 occupies its full open position for free unrestricted or unthrottled flow of air into the upper end of the cylinder as long as piston 9 is below the upper end head 5A far enough to release the upper valve member 157. Air is vented from the lower end of the cylinder 3 (below piston 9) to the exhaust chamber 47 in block 19 via the annular space around the valve member 157 in the recess 153 of the lower throttle means 151B, section 155 of this recess, passages 41 and 39 (constituting feed passage 33B), port 31B, the cavity in the D-valve 67, exhaust port 29, exhaust air passage 43, chamber 47 and the noise suppressor 45. Thus, with pressure air delivered to the upper end of the cylinder 3 above the motor piston 9, and air vented from the lower end of the cylinder, the piston is driven down through a downstroke.

As the motor piston 9 approaches the lower end of its downstroke, it engages the upper end of the valve member 157 of the lower throttle means 151B, and, as it completes its downstroke, it drives this valve member 157 down against the upward return bias of spring 167 of the lower throttle means thereby throttling the exhaust of air from the lower end of the cylinder and cushioning piston 9 to prevent it from striking the lower end head 5B. The throttling occurs as section 159 of the valve member 157 of the lower throttle means is pushed down by the piston 9 into the lower section 155 of recess 153 of the lower throttle means to provide the restricted annular passage for exit of air indicated at 165 in FIG. 10. The piston may be made of aluminum (for its low mass) and the valve member 157 of nylon to reduce the clatter of the piston against the valve member.

As the motor piston 9 approaches the lower end of its downstroke, it also engages the push button end 119 of the valve stem 117 of the lower exhaust valve 77B. As it completes its downstroke, it drives this valve stem 117 down. As the stem moves down, it compresses the air in chamber 129 which acts via the head 93 of the valve member 91 of the exhaust valve 77B to drive member 91 down to open its flange 97 off the valve seat 85. The stem 117 acts as a dashpot piston, forcing the air in chamber 129 out through the restricted annular space around the tip 121 of the stem in the hole 131 in the head 93 of the valve member 91 of the exhaust valve 77B, and this controls the timing of the opening of the valve member 91 to provide for substantially the same limit on the downstroke of the piston 9 for different speeds of the piston 9. Upon opening of the valve member 91 of the lower exhaust valve B, air is vented from the upper end of the bore 49A in the valve chest via the exhaust passage 71 which is in communication with extension 75c of the recess 75B in the lower end head 5B, section 75b of this recess, the radial ports 105 in extension 103 of the valve body 83 of valve 77B, the respective passage 111, the feed passage 41, passage 39, port 31B, the D-valve 67 and the exhaust port 29. On this venting of air from the upper end of bore 49A, the valve actuator 55 is driven up to the raised position wherein the upper end of its upper piston 59A engages the inside face of projection 21 of the upper end head 5A by pressure air in chamber 51 in the valve chest acting on the lower end of the upper piston 59A of the actuator 55. Pressure on the upper and lower ends of the lower piston 59B is balanced by reason of bleed of pressure air through the bleed passage 63 in the lower piston.

The valve actuator 55, in moving up to its upper position, drives the D-valve 67 up from its FIG. 4 lower position to its upper position wherein it provides for communication of pressure air from chamber 51 to the lower end of the cylinder 3 (below the motor piston 9) via port 31B, passages 39 and 41 (constituting feed passage 33B), section 155 of recess 153 in the lower end head 5B and the annular space around the valve member 157 of the lower throttle means 151B in this recess 153. Air is vented from the upper end of the cylinder 3 (above piston 9) to the exhaust chamber 47 in block 19 via the annular space around the valve member 157 in the recess 153 of the upper throttle means 151A, section 155 of this recess, passages 37 and 35 (constituting feed passage 33A), port 31A, the cavity in the D-valve 67, exhaust port 29, exhaust air passage 43, chamber 47 and the noise suppressor 45. Thus, with pressure air delivered to the lower end of the cylinder 3 below the motor piston 9, and air vented from the upper end of the cylinder, the piston is driven up through an upstroke. As the piston 9 moves up from the lower end of its stroke, it releases the lower valve member 157 for return to its full open position for unthrottled delivery of pressure air to the lower end of the cylinder.

As the motor piston 9 approaches the upper end of its upstroke, it engages the lower end of the valve member 157 of the upper throttle means 151A, and, as it completes its upstroke, it drives this valve member 157 up against the downward return bias of spring 167 of the upper throttle means thereby throttling the exhaust of air from the upper end of the cylinder and cushioning piston 9 to prevent it from striking the upper end head 5A. The throttling occurs as section 159 of the valve member 157 of the upper throttle means is pushed up by the piston 9 into the upper section 155 of recess 153 of the upper throttle means to provide the restricted annular passage for exit of air (such as indicated at 165 in FIG. 10 for the lower throttle means).

As the motor piston 9 approaches the upper end of its stroke, it also engages the push button end 119 of the valve stem 117 of the upper exhaust valve 77A. As it completes its upstroke, it drives this valve stem 117 up. As the stem moves up, it compresses the air in chamber 129 which acts via the head 93 of the valve member 91 of the exhaust valve 77A to drive this member 91 up to open its flange 97 off the valve seat 85. As in the case of the lower exhaust valve 77B, the stem 117 acts as a dashpot piston, forcing the air in chamber 129 out through the restricted annular space around the tip 121 of the stem in the hole 131 in the head 93 of the valve member 91 of the exhaust valve 77A, and this controls the timing of the opening of the valve member 91 to provide for substantially the same limit on the upstroke of the piston 9 for different speeds of the piston 9. Upon opening of the valve member 91 of the upper exhaust valve 77A, air is vented from the lower end of the bore 49B in the valve chest via the exhaust passage 73 which is in communication with extension 75c of the recess 75A in the upper end head 5A, section 75b of this recess, the radial ports 105 in extension 103 of the valve body 83 of valve 77A, the respective passage 111, the feed passage 37, passage 35, port 31A, the D-valve 67, the exhaust port 29, chamber 47 and the noise suppressor 45. On this venting of air from the lower end of bore 49B, the valve actuator 55 is driven down to its lowered position of FIG. 4 wherein the lower end of its lower piston 59B engages the inside face of projection 21 of the lower end head 5B by pressure air in chamber 51 in the valve chest acting on the upper end of the lower piston 59B of the actuator 55. Pressure on the upper and lower ends of the upper piston 59A is balanced by reason of bleed of pressure air through the bleed passage 63 in this piston.

The valve actuator 55, in moving down to its lower position, drives the D-valve down to its FIG. 4 lower position, and the cycle repeats.

It will be observed that the D-valve 67 of the motor is operable by the pressure air (in chamber 51 of the valve chest 17) which is supplied for driving the piston 9, without the use of any overcentering or rocker arm mechanism, by means of the air-operated actuator 55 for the D-valve and the exhaust valves 77A and 77B at the upper and lower ends of the cylinder operable by the piston 9. Each of the exhaust valves has means (tip 121 of valve stem 115 slidable in the hole 131 in the head 93 of valve member 91, and chamber 129) responsive to the speed of the piston 9 for timing its opening to occur substantially at the same point in the travel of the piston for maintaining substantially the same length of stroke of the piston for different speeds of the piston. In this regard, it will be observed that if the piston 9 is travelling down relatively fast, it drives the stem 115 of the lower exhaust valve 77B down relatively fast and acts via the air in chamber 129 (which is unable to escape rapidly) to drive the valve member 91 to its open position for piston reversal with valve member 91 opening relatively fast and generally in the time it takes the piston to reach the predetermined lower limit of its stroke. If the piston is travelling down relatively slowly, it drives the stem 115 of the lower exhaust valve 77B down relatively slowly, enabling air to escape from chamber 129 through the restricted opening around the tip 121 of the stem, and slowing down the opening of the valve member so that it opens generally in the time it takes the piston to reach the predetermined lower limit of its stroke. The action on the upstroke of the piston 9 is similar, the upper exhaust valve 77A functioning similarly to the lower exhaust valve. With the throttling of the exhaust of air from the upper and lower ends of the cylinder 3 by the throttle valve means 151A and 151B as the piston 9 approaches the upper and lower ends of the cylinder, the piston is cushioned at the ends of its stoke and reverses without clattering against the end heads 5A, 5B. The passaging (71, 73) for the air system for the D-valve actuator 55 is such that it may readily be provided by boring in the end heads 5A and 5B and the valve chest 17.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An expansible chamber motor comprising:

a cylinder having first and second end heads;

a motor piston reciprocable in the cylinder between said end heads;

valve mechanism for the motor comprising air passage means having a valve face at one side of the cylinder, a central exhaust port and first and second feed ports on opposite sides of the exhaust port, with said ports in line endwise of the motor, a first feed passage in communication at one end with the first feed port and at its other end with a first end of the cylinder, and a second feed passage in communication at one end with the second feed port and at its other end with the second end of the cylinder;

a valve chest extending along said valve face having first and second aligned piston-receiving bores at its opposite ends with a chamber between said bores for air under pressure;

a valve actuator movable axially in said chest, said valve actuator having a central portion and first and second pistons at the ends of said central portion slidable in said first and second piston-receiving bores, said pistons at their inner ends being exposed to pressure air in said chamber;

said chamber being in restricted communication with the outer ends of said bores;

a D-valve movable with the actuator and slidable on said valve face, said D-valve being movable with the actuator between a first position wherein it provides for communication of pressure air from said chamber through the first feed port via said first feed passage to said first end of the cylinder, and for exhaust of air from the second end of the cylinder via the second feed passage, the second feed port and the D-valve to the exhaust port for driving the motor piston in the direction from the first to the second end head, and a second position wherein it provides for communication of pressure air from said chamber through said second feed port via said second feed passage to said second end of the cylinder and for exhaust of air from the first end of the cylinder via the first feed passage, the first feed port and the D-valve to the exhaust port, for driving the motor piston in the opposite direction;

a first exhaust passage for exhausting air from the outer end of the first piston-receiving bore;

a second exhaust passage for exhausting air from the outer end of the second piston-receiving bore;

a first exhaust valve for the first exhaust passage operable by the piston as the piston approaches said second end of the cylinder for exhausting air from the outer end of the first piston-receiving bore thereby to move the actuator to move the D-valve from the first to the second position;

a second exhaust valve for the second exhaust passage operable by the piston as the piston approaches said first end of the cylinder for exhausting air from the outer end of the second piston-receiving bore, thereby to move the actuator to move the D-valve from the second to the first position;

first valve means comprising a first throttle valve member mounted for a movement in said other end of said first feed passage away from an open position toward a throttling position wherein it restricts the exit of air from said first end of the cylinder via the first feed passage, said first throttle member extending into the cylinder from said other end of said first feed passage and being engageable by the piston as it approaches the first end of the cylinder for being moved to said throttling position thereby to cushion the piston and prevent it from striking said first end head; and, second valve means comprising a second throttle valve member mounted for movement in said other end of said second feed passage away from an open position toward a throttling position wherein it restricts the exit of air from said second end of the cylinder via the second feed passage, said second throttle member extending into the cylinder from said other end of said second feed passage and being engageable by the piston as it approaches the second end of the cylinder for being moved to said throttling position thereby to cushion the piston and prevent it from striking said second end head.

2. An expansible chamber motor as set forth in claim 1 wherein each of the exhaust valves comprises means responsive to the speed of the motor piston for timing the opening of the exhaust valve to occur substantially at the same point in the travel of the piston for maintaining substantially the same length of stroke of the piston for different speeds of the piston.

3. An expansible chamber motor as set forth in claim 1 wherein the first exhaust valve is mounted in the second end head at the second end of the cylinder, the second exhaust valve is mounted in the first end head at the first end of the cylinder, the valve chest extends between the end heads, the first exhaust passage extends from the outer end of the first piston-receiving bore through the first end head, the valve chest and the second end head to the first exhaust valve, and the second exhaust passage extends from the outer end of the second piston-receiving bore through the second end head, the valve chest and the first end head to the second exhaust valve.

4. An expansible chamber motor as set forth in claim 3 wherein each exhaust valve comprises a valve seat, a valve member biased toward engagement with the seat, and a valve stem extending into the cylinder engageable by the piston for moving the valve member away from the valve seat.

5. An expansible chamber motor as set forth in claim 1 wherein said first feed passage extends in the first end head to the first valve means and said second feed passage extends in the second end head to the second valve means.

6. An expansible chamber motor as set forth in claim 1 having means for effecting a snap action of said valve actuator and preventing it from dead centering.

7. An expansible chamber motor as set forth in claim 6 wherein said snap-acting means comprises a detent mounted in the valve chest, and spring-biased means carried by the valve actuator engageable with the detent.

8. An expansible chamber motor comprising:

a cylinder having first and second end heads;

a motor piston reciprocable in the cylinder between said end heads;

valve mechanism for the motor comprising air passage means having a valve face at one side of the cylinder, a central exhaust port and first and second feed ports on opposite sides of the exhaust port, with said ports in line endwise of the motor, a first feed passage in communication at one end with the first feed port and at its other end with a first end of the cylinder, and a second feed passage in communication at one end with the second feed port and at its other end with the second end of the cylinder;

a valve chest extending between the end heads along said valve face having first and second aligned piston-receiving bores at its opposite ends with a chamber between said bores for air under pressure;

a valve actuator movable axially in said chest, said valve actuator having a central portion and first and second pistons at the ends of said central portion slidable in said first and second piston-receiving bores, said pistons at their inner ends being exposed to pressure air in said chamber;

said chamber being in restricted communication with the outer ends of said bores;

a D-valve movable with the actuator and slidable on said valve face, said D-valve being movable with the actuator between a first position wherein it provides for communication of pressure air from said chamber through the first feed port via said first feed passage to said first end of the cylinder, and for exhaust of air from the second end of the cylinder via the second feed passage, the second feed port and the D-valve to the exhaust port for driving the motor piston in the direction from the first to the second end head, and a second position wherein it provides for communication of pressure air from said chamber through said second feed port via said second feed passage to said second end of the cylinder and for exhaust of air from the first end of the cylinder via the first feed passage, the first feed port and the D-valve to the exhaust port, for driving the motor piston in the opposite direction;

a first exhaust passage for exhausting air from the outer end of the first piston-receiving bore;

a second exhaust passage for exhausting air from the outer end of the second piston-receiving bore;

a first exhaust valve for the first exhaust passage mounted in the second end head at the second end of the cylinder and operable by the piston as the piston approaches said second end of the cylinder for exhausting air from the outer end of the first piston-receiving bore thereby to move the actuator to move the D-valve from the first to the second position, said first exhaust passage extending from the outer end of the first piston-receiving bore through the first end head, the valve chest, and the second end head to the first exhaust valve; and a second exhaust valve for the second exhaust passage mounted in the first end head at the first end of the cylinder and operable by the piston as the piston approaches said first end of the cylinder for exhausting air from the outer end of the second piston-receiving bore, thereby to move the actuator to move the D-valve from the second to the first position, said second exhaust passage extending from the outer end of the second piston-receiving bore through the second end head, the valve chest and the first end head to the second exhaust valve;

each exhaust valve comprising a valve seat, a valve member biased toward engagement with the seat, a valve stem extending into the cylinder engageable by the piston for moving the valve member away from the valve seat, and a dashpot chamber between the stem and the valve member.

9. An expansible chamber motor comprising:

a cylinder having first and second end heads;

a motor piston reciprocable in the cylinder between said end heads;

valve mechanism for the motor comprising air passage means having a valve face at one side of the cylinder, a central exhaust port and first and second feed ports on opposite sides of the exhaust port, with said ports in line endwise of the motor, a first feed passage in communication at one end with the first feed port and at its other end with a first end of the cylinder, and a second feed passage in communication at one end with the second feed port and at its other end with the second end of the cylinder;

a valve chest extending along said valve face having first and second aligned piston-receiving bores at its opposite ends with a chamber between said bores for air under pressure;

a valve actuator movable axially in said chest, said valve actuator having a central portion and first and second pistons at the ends of said central portion slidable in said first and second piston-receiving bores, said pistons at their inner ends being exposed to pressure air in said chamber;

said chamber being in restricted communication with the outer ends of said bores;

a D-valve movable with the actuator and slidable on said valve face, said D-valve being movable with the actuator between a first position wherein it provides for communication of pressure air from said chamber through the first feed port via said first feed passage to said first end of the cylinder, and for exhaust of air from the second end of the cylinder via the second feed passage, the second feed port and the D-valve to the exhaust port for driving the motor piston in the direction from the first to the second end head, and a second position wherein it provides for communication of pressure air from said chamber through said second feed port via said second feed passage to said second end of the cylinder and for exhaust of air from the first end of the cylinder via the first feed passage, the first feed port and the D-valve to the exhaust port, for driving the motor piston in the opposite direction;

a first exhaust passage for exhausting air from the outer end of the first piston-receiving bore;

a second exhaust passage for exhausting air from the outer end of the second piston-receiving bore;

a first exhaust valve for the first exhaust passage operable by the piston as the piston approaches said second end of the cylinder for exhausting air from the outer end of the first piston-receiving bore thereby to move the actuator to move the D-valve from the first to the second position;

a second exhaust valve for the second exhaust passage operable by the piston as the piston approaches said first end of the cylinder for exhausting air from the outer end of the second piston-receiving bore, thereby to move the actuator to move the D-valve from the second to the first position;

first valve means mounted in the first end head and operable by the piston as it approaches the first end of the cylinder for restricting the exit of air from said first end of the cylinder via said first feed passage to cushion the piston and prevent it from striking said first end head; and second valve means mounted in the second end head and operable by the piston as it approaches the second end of the cylinder for restricting the exit of air from said second end of the cylinder via said second feed passage to cushion the piston and prevent it from striking said second end head;

said first feed passage extending in the first end head to the first valve means and said second feed passage extending in the second end head to the second valve means;

each feed passage being in communication with a recess in the respective end head and each of said first and second valve means comprising a valve member movable from a first position out of the recess for relatively unrestricted flow of air to and from the cylinder to a second position in the recess providing a restricted annular passage around the valve member in the recess, each valve member being biased to its first position and movable to its second position by the motor piston as it approaches the respective end head.

10. An expansible chamber motor comprising:

a cylinder having first and second end heads;

a motor piston reciprocable in the cylinder between said end heads;

valve mechanism for the motor comprising air passage means having a valve face at one side of the cylinder, a central exhaust port and first and second feed ports on opposite sides of the exhaust port, with said ports in line endwise of the motor, a first feed passage in communication at one end with the first feed port and at its other end with a first end of the cylinder, and a second feed passage in communication at one end with the second feed port and at its other end with the second end of the cylinder;

a valve chest extending along said valve face having a chamber for air under pressure;

a D-valve slidable on the valve face between a first position wherein it provides for communication of pressure air from said chamber through the first feed port via said first feed passage to said first end of the cylinder, and for exhaust of air from the second end of the cylinder via the second feed passage, the second feed port and the D-valve to the exhaust port for driving the motor piston in the direction from the first to the second end head, and a second position wherein it provides for communication of pressure air from said chamber through said second feed port via said second feed passage to said second end of the cylinder and for exhaust of air from the first end of the cylinder via the first feed passage, the first feed port and the D-valve to the exhaust port, for driving the motor piston in the opposite direction;

means controlled by the movement of the motor piston for actuating the D-valve;

first valve means comprising a first throttle valve member mounted for movement in said other end of said first feed passage away from an open position toward a throttling position wherein it restricts the exit of air from said first end of the cylinder via the first feed passage, said first throttle member extending into the cylinder from said other end of said first feed passage and being engageable by the piston as it approaches the first end of the cylinder for being moved to said throttling position thereby to cushion the piston and prevent it from striking said first end head; and, second valve means comprising a second throttle valve member mounted for movement in said other end of said second feed passage away from an open position toward a throttling position wherein it restricts the exit of air from said second end of the cylinder via the second feed passage, said second throttle member extending into the cylinder from said other end at said second feed passage and being engageable by the piston as it approaches the second end of the cylinder for being moved to said throttling position thereby to cushion the piston and prevent it from striking said second end head.

11. An expansible chamber motor as set forth in claim 10 wherein said first feed passage extends in the first end head to the first valve means and said second feed passage extending in the second end head to the second valve means.

12. An expansible chamber motor as set forth in claim 11 wherein each feed passage is in communication with a recess in the respective end head and each of said first and second valve means comprises a valve member movable from a first position out of the recess for relatively unrestricted flow of air to and from the cylinder to a second position in the recess providing a restricted annular passage around the valve member in the recess, each valve member being biased to its first position and movalbe to its second position by the motor piston as it approaches the respective end head.

* * * * *